United States Patent [19]

Kitsuki

[11] Patent Number: 5,035,325

[45] Date of Patent: Jul. 30, 1991

[54] CASSETTE FOR THERMAL TRANSFER PRINTING FILM

[75] Inventor: Kengo Kitsuki, Tokyo, Japan

[73] Assignee: Dai Nippon Insatsu Kabushiki Kaisha, Tokyo, Japan

[21] Appl. No.: 552,508

[22] Filed: Jul. 16, 1990

[30] Foreign Application Priority Data

Jul. 18, 1989 [JP] Japan ..... 1-84178

[51] Int. Cl.[5] ..... B65D 73/00; B65D 85/67

[52] U.S. Cl. ..... 206/459; 101/DIG. 46

[58] Field of Search ..... 206/459; 101/DIG. 45, 101/DIG. 46

[56] References Cited

U.S. PATENT DOCUMENTS 4,665,824 5/1987 Greiner et al. ..... 101/DIG. 46
4,878,407 11/1989 Harrison et al. ..... 101/DIG. 46

FOREIGN PATENT DOCUMENTS 2235779 1/1974 Fed. Rep. of Germany ..... 206/459
64-8569 1/1989 Japan .
191370 4/1989 Japan .

*Primary Examiner*—William I. Price
*Attorney, Agent, or Firm*—Wegner, Cantor, Mueller & Player

[57] ABSTRACT

In a thermal transfer printing film cassette having a cassette case and a thermal transfer printing film housed in the case, an outer surface of the case is provided with a plurality of marking positions at which reflective marks are applied. The marks indicate the usage and ink characteristics of the printing film, depending upon their position. When the cassette is mounted in a printer, sensors detect the marks and send signals to a ROM in which various types of operational conditions corresponding to the ink characteristics and usage are stored. And such conditions are automatically set to the printers, which then operates in a manner suitable for the film in the cassette.

14 Claims, 2 Drawing Sheets

CASSETTE FOR THERMAL TRANSFER PRINTING FILM

BACKGROUND OF THE INVENTION

The present invention relates to a cassette for heat-sensitive transfer printing film used in thermal transfer printers.

Conventionally, cassettes for thermal transfer printing film have been used in order to facilitate the mounting of the thermal transfer printing film to the thermal transfer printer. On one and the other side of a cassette case for such thermal transfer printing film are a feed roller that feeds out the thermal transfer printing film and a take-up roller that winds up the thermal transfer printing film. When such a cassette is mounted to a printer, a drive mechanism of the printer is linked to the take-up roller, a portion of the film that extends from the feed roller to the take-up roller is brought into contact with the thermal head of the printer, the take-up roller is rotated by the drive mechanism and the thermal transfer printing film is drawn out of the feed roller so that it passes the thermal head where image recording is performed.

Usually there are different types of transfer conditions for the recording and of the uses of the sheets having thereon the image transferred by thermal transfer printing. Accordingly, a plural number of types of thermal transfer printing film are made available so as to correspond to these different conditions and uses. Because of this, there has been the problems of a cassette containing an unsuitable type of film being erroneously mounted to the printer, of the recording being performed under transfer conditions that are not appropriate for the film, and of a film suitable for another use being used.

SUMMARY OF THE INVENTION

In the light of these problems that exist with conventional thermal transfer printing film cassettes, the object of the present invention is to provide a thermal transfer printing film cassette whereby the usage and the ink characteristics of the thermal transfer printing film housed in the cassette can be automatically identified by the printer by simply mounting that cassette to the printer.

In order to attain the above object, the thermal transfer printing film cassette of the present invention has a cassette case having an outer surface provided with a reflective mark that, depending upon its position, indicates the ink characteristics of the thermal transfer printing film.

In another form of the present invention, the outer surface of the cassette case is provided with a reflective mark that, depending upon its position, indicates the usage of the thermal transfer printing film.

The reflective mark may be a seal that is affixed to the outer surface of the cassette case, or may be a pattern that is printed onto the outer surface of the cassette case.

When a thermal transfer printing film cassette having the configuration described above is mounted to a printer, a reflection-type sensor built into the printer reads the reflective mark on the outer surface of the cassette case and automatically identifies that information and recognizes the ink characteristics and the usage.

An embodiment of the present invention will now be described in detail with reference to the accompanying drawings.

DESCRIPTION OF THE PREFERRED EMBODIMENT

Figure 1:
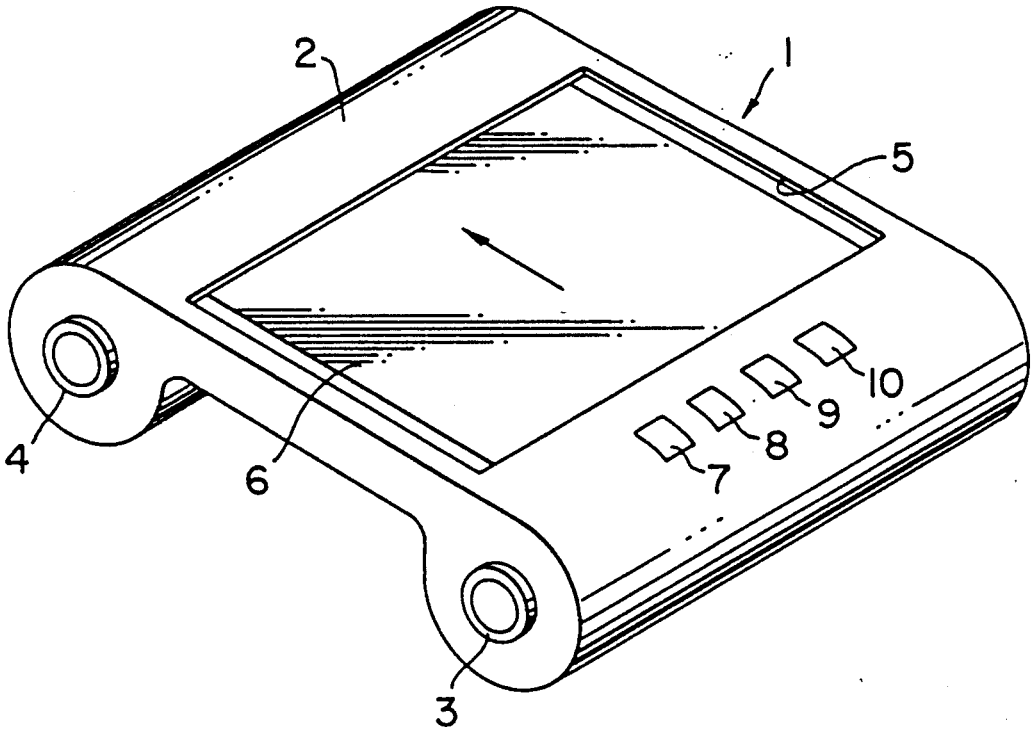
FIG. 1 is a perspective view indicating the entire configuration of a thermal transfer printing film cassette according to the present invention.

FIG. 1 shows a thermal transfer printing film cassette 1 according to the present invention. The numeral 2 indicates a black-colored cassette case 2 made of polystyrene or ABS resin (acrylonitrile-butadienestyrene resin). The case 2 houses in one side thereof a feed roll 3 for a thermal transfer printing film 6. The feed roll 3 is rotatable inside the cassette case 2. The case 2 houses in the other side thereof a rotatable take-up roll 4. There is a window 5 formed in the cassette case 2 between the two rolls 3 and 4. The leading end of the printing film 6 is drawn out from the feed roll 3 and taken up by the take-up roll 4.

Seals 7 through 10 of a PET film to which aluminum has been vapor deposited are affixed at appropriate positions on the outer surface of the cassette case 2. These positions indicates different types of usage and ink characteristics of the thermal transfer printing film 6. The positions at which the seals 7 through 10 are affixed are preferably on the outer surface of the casing part around the feed roll 3. The seals 7 through 10 may be arranged on a line parallel to the axis of the feed roll 3, as shown. The seals may be replaced by marks of any kind.

In the present embodiment, the position 7 is provided with a reflective mark that indicates the ink characteristics. A high-density film is indicated if there is a seal affixed at this position, and a standard-density film is indicated if there is not a seal affixed at this position. Furthermore, reflective marks indicating the use are provided to the positions 8 through 10. For example, monochrom usage is indicated if there is a seal affixed at the position 8, and color usage is indicated if not. In addition, OHP (overhead projector) usage is indicated if there is a seal affixed at the position 9, and transfer to cloth is indicated if there is a seal affixed at the position 10. Combinations of positions of seals can also be used to indicate other modes.

Figure 2:
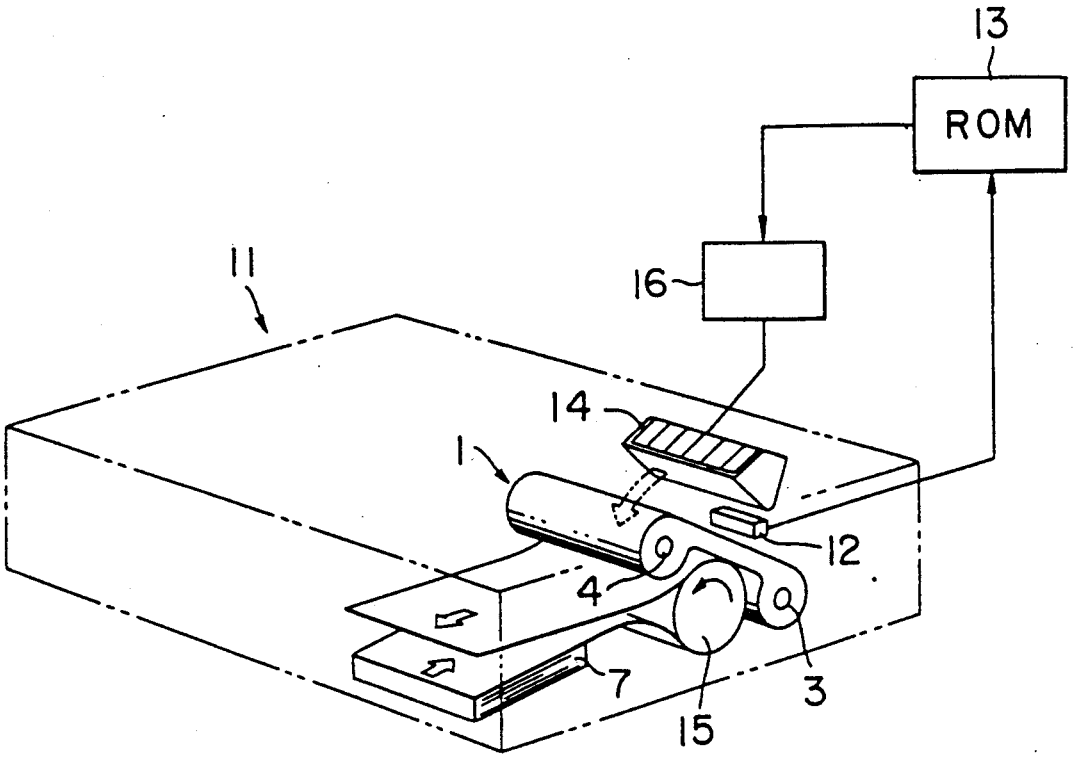
FIG. 2 is a schematic perspective view showing the principle of operation of a printer in which the film cassette of FIG. 1 can be mounted for printing.
Figure 3:
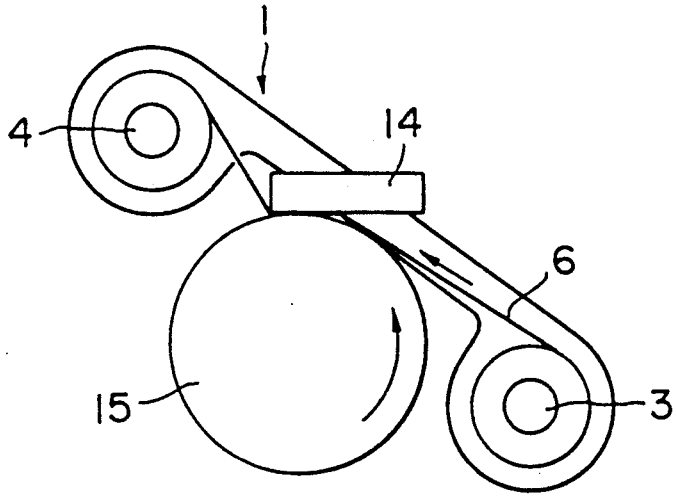
FIG. 3 is a side view showing the relationship of the film cassette, a thermal head of the printer and a platen roller.

The following is a description of the usage of the thermal transfer printing film cassette 1 having the organization described above. FIG. 2 shows a printer 11 in which the thermal transfer printing film cassette 1 is to be used. The printer 11 is provided with reflection sensors 12 corresponding to the mark positions 7 through 10. When the thermal transfer printing film cassette 1 is mounted to the printer 11, these sensors 12 send signals to a ROM 13 in which various types of operational conditions corresponding to the ink characteristics and usage have been stored beforehand, so that it is possible to change and set the conditions for the output energy to a thermal head 14 of the printer. The thermal head 14 is moved to and away from its operative position by means of an actuator 16. After this, when the printer 11 is started, the take-up roll 4 is driven and the thermal transfer printing film 6 is fed between the thermal head 14 and a platen roller 15 in the direction indicated by the arrow in FIG. 1 and FIG. 3, and image recording in accordance with the thus set usage and ink characteristics of the thermal transfer printing film 6 is performed by the thermal head 14 onto sheets 7 fed one by one in a manner known in the art. Each of the sheets 7 may have at an appropriate position thereon a mark indicating the usage (such as standard use or use for OHP). Upon each sheet arriving an appropriate position in the printer 11, the mark is detected by a sensor, and only when the usage of the sheet corresponds to the usage of the transfer printing film 6 indicated by the mark on the cassette 1, the printer 1 operates to carry out printing.

In the embodiment described above, the color of the cassette case 2 is black, and the seals of PET film to which aluminum has been vapor deposited are affixed at the mark positions. But the seals may be ones wherein patterns are formed by performing UV printing or the like using black ink onto a PET film that has had aluminum vapor deposited thereon. In this case, it is not necessary for the outer surface of the cassette case 2 to be specifically black. In the case where the outer surface of the cassette case 2 is black, hot stamping or some other printing method can be used to directly apply a pattern as reflective marks to the outer surface of the cassette case 2.

In the case where it is thought that the PET film seal with aluminum vapor deposition may fall off or exert an adverse influence to the base inside the printer, then a PET film seal to which non-conductive aluminum has been vapor deposited, can be used.

As has been described above, the thermal transfer printing film cassette according to the present invention has on its outer surface reflective marks that indicate the usage and the ink characteristics of a thermal transfer printing film so that when the cassette is mounted in a printer, reflection sensors inside the printer read the reflective marks and use the information as the basis for automatically setting the printer operation conditions so that there are no errors in the usage conditions even if there is a plural number of cassette types.

What is claimed is:

1. A thermal transfer printing film cassette having a cassette case, and a thermal transfer printing film housed inside said cassette case, said cassette having an outer surface provided with a plurality of marking positions, and at least one reflective mark applied to one of said positions, said reflective mark, depending upon its position, indicating the ink characteristics of the thermal transfer printing film.

2. The thermal printing film cassette as claimed in claim 1, wherein said reflective mark is a seal affixed to said position.

3. The thermal printing film cassette as claimed in claim 2, wherein said seal is a PET film to which an aluminum layer is deposited.

4. The thermal printing film cassette as claimed in claim 1, wherein said reflective mark is a pattern printed on said position.

5. The thermal printing film cassette as claimed in claim 1, wherein said outer surface is a surface part of the cassette case housing a film roll.

6. The thermal printing film cassette as claimed in claim 4, wherein said positions are disposed on a line parallel to a rotational axis of said film roll.

7. The thermal printing film cassette as claimed in claim 1, wherein the cassette case is black colored.

8. A thermal transfer printing film cassette having a cassette case, and a thermal transfer printing film housed inside said cassette case, said cassette having an outer surface provided with a plurality of marking positions, and at least one reflective mark applied to one of said positions, said reflective mark, depending upon its position, indicating the usage of the thermal transfer printing film.

9. The thermal printing film cassette as claimed in claim 8, wherein said reflective mark is a seal affixed to said position.

10. The thermal printing film cassette as claimed in claim 9, wherein said seal is a PET film to which an aluminum layer is deposited.

11. The thermal printing film cassette as claimed in claim 8, wherein said reflective mark is a pattern printed on said position.

12. The thermal printing film cassette as claimed in claim 8, wherein said outer surface is a surface part of the cassette case housing a film roll.

13. The thermal printing film cassette as claimed in claim 11, wherein said positions are disposed on a line parallel to a rotational axis of said film roll.

14. The thermal printing film cassette as claimed in claim 8, wherein the cassette case is black colored.

* * * * *